US009074315B2

(12) United States Patent
Bhadra

(10) Patent No.: US 9,074,315 B2
(45) Date of Patent: Jul. 7, 2015

(54) COMPOSITION AND A PROCESS TO OBTAIN WRINKLE FREE WOOLEN GARMENTS

(75) Inventor: Debashis Bhadra, Bangalore (IN)

(73) Assignee: Aditya Birla Nuvo Limited, Veraval, Gujarat (IN)

( * ) Notice: Subject to any disclaimer, the term of this patent is extended or adjusted under 35 U.S.C. 154(b) by 1359 days.

(21) Appl. No.: 12/863,960

(22) PCT Filed: Dec. 14, 2009

(86) PCT No.: PCT/IB2009/007794

§ 371 (c)(1),
(2), (4) Date: Jul. 21, 2010

(87) PCT Pub. No.: WO2010/128353

PCT Pub. Date: Nov. 11, 2010

(65) Prior Publication Data

US 2011/0138515 A1 Jun. 16, 2011

(51) Int. Cl.

| | |
|---|---|
| ***D06M 15/15*** | (2006.01) |
| ***D06M 15/564*** | (2006.01) |
| ***D06M 15/705*** | (2006.01) |
| ***D06M 15/568*** | (2006.01) |
| ***D06M 23/06*** | (2006.01) |

(52) U.S. Cl.
CPC ..... *D06M 15/15* (2013.01); *D06M 15/564* (2013.01); *D06M 15/568* (2013.01); *D06M 15/705* (2013.01); *D06M 23/06* (2013.01)

(58) Field of Classification Search
CPC ..... D06M 15/564; D06M 15/568; D06M 15/705; D06M 23/06; D06M 2200/20
USPC ..... 252/8.61, 8.91; 8/115.6, 128.1
See application file for complete search history.

(56) References Cited

U.S. PATENT DOCUMENTS

| | | | | |
|---|---|---|---|---|
| 4,940,737 | A * | 7/1990 | Braatz et al. | 521/103 |
| 5,597,386 | A * | 1/1997 | Igarashi et al. | 8/405 |
| 7,300,647 | B1 * | 11/2007 | O'Toole et al. | 424/70.1 |

FOREIGN PATENT DOCUMENTS

| | | | |
|---|---|---|---|
| JP | 6100679 | A | 1/1986 |
| JP | 1113230 | A | 5/1989 |
| JP | 7011580 | A | 1/1995 |

OTHER PUBLICATIONS

PCT International Search Report and Written Opinion, PCT/IB2009/007794, Feb. 18, 2010, 9 Pages.

* cited by examiner

*Primary Examiner* — Amina Khan
(74) *Attorney, Agent, or Firm* — Fenwick & West LLP

(57) ABSTRACT

The present disclosure relates to a composition comprising cross linking agents, polymers, proteins and alkaline reducing agents to obtain wrinkle free woolen garment. The present disclosure further relates to a method of obtaining said composition along with a process of obtaining the wrinkle free woolen garment. The disclosure also relates to the treated garment.

14 Claims, 1 Drawing Sheet

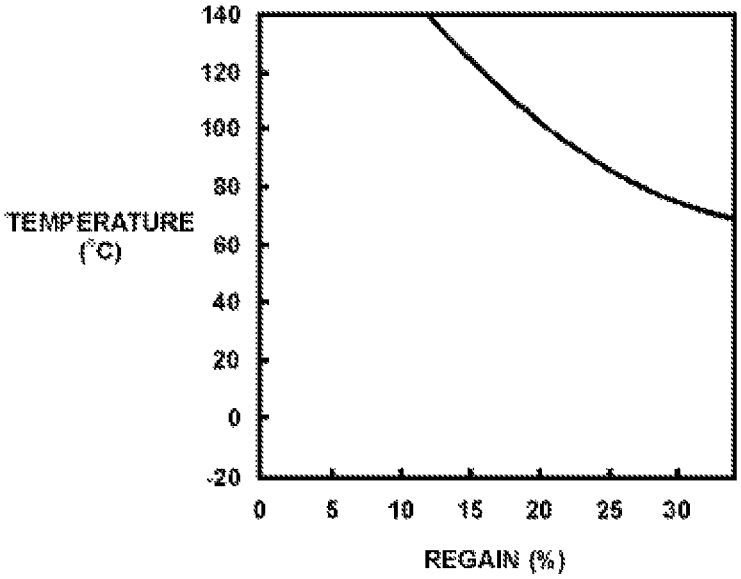
140
120
100
80
60
40
20
0
-20
TEMPERATURE
(°C)
0
5
10
15
20
25
30
REGAIN (%)

COMPOSITION AND A PROCESS TO OBTAIN WRINKLE FREE WOOLEN GARMENTS

TECHNICAL FIELD

The present disclosure relates to a composition to obtain wrinkle free woolen garment. The present disclosure further relates to a method of obtaining said composition along with a process of obtaining the wrinkle free woolen garment.

BACKGROUND AND PRIOR ART

Permanent Setting of Wool

Permanent setting takes place in wool because the disulphide bond cross links that stabilise the protein matrix can be rearranged under appropriate conditions of pH, temperature and humidity. The chemical basis for rearrangement of the disulphide cross links is the thiolate-disulphide exchange reaction. The rate at which the disulphide bonds rearrange depends on the temperature and the thiolate ion concentration. The thiolate ion concentration can vary with the previous history of the wool and the pH of the fabric. Chemically assisted permanent setting treatments all increase the rate of setting by raising the concentration of thiolate groups. The thiolate concentration in wool can be increased in two ways:

reaction with reducing agents, increasing the pH.

Hence, many setting agents combine both of these aspects. The use of after-treatments following chemical setting is highly desirable to stabilize the wool by inhibiting further thiol/disulphide interchange. This is achieved by oxidising any free thiol groups, and by re-establishing an acidic pH in the fibre.

In practice, the rate of permanent setting is determined by a number of variables such as conditions of temperature, regain, duration of time, pH etc. FIG. 1 shows the approximate conditions of temperature and regain that are required to achieve 50% permanent set within 10 minutes at pH 5.5, with untreated wool. These represent approximately minimum conditions for batch treatments.

Under practical conditions, permanent setting is always less than 100%. This is because stress relaxation is never complete. Complete relaxation is prevented by the rigidity of the protein crystals in the matrix, the inability of some of the crosslinks in wool to rearrange (e.g. lanthionine) and the introduction of more non-labile crosslinks while disulphide bond rearrangement is taking place.

During processing, permanent setting of distortions should be avoided whenever practically possible since it may not be possible to completely remove permanently set faults such as creases at a later stage. For example, running marks permanently set into fabric, during scouring or piece dyeing, may not be completely removed by any subsequent permanent setting processes.

The most important dimensional properties: relaxation shrinkage and hygral expansion, quantify changes in fabric dimensions in response to changes in the environment. Hygral expansion or "hygral behavior" is important mainly for the hydrophilic fibers and the largest and most important effects are found only with wool and cotton.

Shrink Proofing of Wool

Wool can be made shrink resistant in two different ways.

1. The surface scales on the fibres can be modified or
2. The fibres can be bonded together using a polymer.

The modification of the woolen fibers can be achieved as following:

Oxidation with chlorine (in the form of chlorination) in aqueous treatments causes the scales to be partly dissolved and they loose their ability to tangle together by the ratcheting mechanism and hence the surface scales of the fiber get modified.

If an adherent polymer is applied by a pad-dry procedure, a high proportion of the fibers become bonded together at a few points along their length. Thus the fibers are immobilised and cannot migrate and felt together.

The chlorination process involves degradation of the fiber and overall weight is lost, whereas with the resin/polymer process, weight is gained since it is an additive process. Sometimes chlorinated wool is treated with a resin by padding or exhaustion to compensate for the weight loss and suitable resins also increase the shrink resistance to some extent.

Chlorination is almost always the treatment of choice as a preparatory step before printing on wool. In this case a polymer is usually not applied. Treatment levels are equivalent to 1-4% o.w.f. of active chlorine. Chlorination treatments can have several adverse effects, both on the wool fabrics (for example yellowing and harsh handle) and on the environment.

OBJECTIVES OF THE DISCLOSURE

The objective of the present disclosure is to provide a composition. Another objective of the present disclosure is a method to obtain a composition. Yet another objective of the present disclosure is a method for obtaining wrinkle free garment.

Still another objective of the present disclosure is to provide a wrinkle free garment.

STATEMENT OF THE DISCLOSURE

Accordingly the present disclosure relates to a composition comprising cross linking agent, polymer, L-cystine and alkaline reducing agent; a method to obtain a composition comprising cross linking agent, polymer, L-cystine and alkaline reducing agent, said method comprising step of combining cross linking agent, polymer, L-cystine, alkaline reducing agent in water to obtain the composition; a method for obtaining wrinkle free garment, said method comprising step of loading a garment with a composition comprising cross linking agent, polymer, L-cystine and alkaline reducing agent to obtain the wrinkle free garment; a method for obtaining wrinkle free garment, said method comprising steps of—a) loading a garment obtained from pre-treated fabric with a composition comprising cross linking agent, polymer, L-cystine and alkaline reducing agent, and b) treating the loaded garment to obtain the wrinkle free garment; and a wrinkle free garment obtained by loading the garment with the above mentioned composition.

BRIEF DESCRIPTION OF ACCOMPANYING DRAWING

FIG. 1: Minimum temperature and regain conditions for appreciable permanent setting of wool.

DETAILED DESCRIPTION

The present disclosure relates to a composition comprising cross linking agent, polymer, L-cystine and alkaline reducing agent.

In an embodiment of the present disclosure the composition is maintained at a pH ranging from about 8.5 to about 10.5.

In another embodiment of the present disclosure, the composition comprises each of the cross linking agent and polymer at a concentration ranging from about 4% to about 6% of total volume of the composition.

In yet another embodiment of the present disclosure, the L-cystine has a concentration ranging from about 0.5% to about 1.5% of total volume of the composition.

In still another embodiment of the present disclosure, the alkaline reducing agent has concentration ranging from about 2% to about 4% of total volume of the composition.

In still another embodiment of the present disclosure, the cross linking agent is selected from a group comprising bisulfite adduct of tri-functional isocyanate terminated urethane polymer and epoxy-functional polyacrylate preferably polyethylenimine. In still another embodiment of the present disclosure, the polymer is selected from a group comprising polyurethane, polyether polyurethane polymer and polyethylene adipate based hydrophilic polyurethane.

In still another embodiment of the present disclosure, the alkaline reducing agent is selected from a group comprising sodium bisulfite, sodium meta bisulfite and sodium mono ethylamine sulfite.

In still another embodiment of the present disclosure, the composition is formulated into solid forms selected from a group comprising powder and granule.

In still another embodiment of the present disclosure, the composition is formulated into liquid forms selected from a group comprising emulsion, suspension and aerosol using water.

The present disclosure relates to a method to obtain a composition comprising cross linking agent, polymer, L-cystine and alkaline reducing agent, said method comprising step of combining cross linking agent, polymer, L-cystine, alkaline reducing agent in water to obtain the composition.

In an embodiment of the present disclosure, the composition is maintained at a pH ranging from about 8.5 to about 10.5.

In another embodiment of the present disclosure, the pH maintenance of composition generates foam.

In yet another embodiment of the present disclosure, said foam settles in a time period of about 5 minutes to 10 minutes followed by filtration to obtain the composition.

In still another embodiment of the present disclosure, the composition is obtained by combining each of the cross linking agent and the polymer in individual concentration ranging from about 4% to about 6%, L-cystine in concentration ranging from about 0.5% to about 1.5% and alkaline reducing agent in concentration ranging from about 2% to about 4% of total volume of the composition.

The present disclosure relates to a method for obtaining wrinkle free garment, said method comprising step of loading a garment with a composition comprising cross linking agent, polymer, L-cystine and alkaline reducing agent to obtain the wrinkle free garment.

The present disclosure relates to a method for obtaining wrinkle free garment, said method comprising steps of:

1. loading a garment obtained from pre-treated fabric with a composition comprising cross linking agent, polymer, L-cystine and alkaline reducing agent, and
2. treating the loaded garment to obtain the wrinkle free garment.

In an embodiment of the present disclosure, the composition is maintained at a pH ranging from about 8.5 to about 10.5.

In another embodiment of the present disclosure, the pretreatment of the fabric is carried out by chlorination using known methods.

In yet another embodiment of the present disclosure, the treatment comprises steps of drying, pressing, curing, neutralization and oxidation of the loaded garment.

In still another embodiment of the present disclosure, curing is carried out at temperature ranging from about 155° C. to about 165° C.

In still another embodiment of the present disclosure, the neutralization is carried out using acidic solutions selected from a group comprising acetic acid and formic acid.

In still another embodiment of the present disclosure, the oxidation is carried out using hydrogen peroxide as an oxidizing agent.

The present disclosure relates to a wrinkle free garment obtained by loading the garment with the above mentioned composition.

In an embodiment of the present disclosure, in degradative processes, the wool is first treated with an oxidizing agent and then oxidized protein is removed from the surfaces of the fibers by washing. Oxidation is most commonly carried out by chlorination using a product such as Basolan DC. This is a form of DCCA (sodium salt of dichloroisocyanuric acid). After the oxidation treatment, a soft, cationic polymer such as Basolan SW may then be applied to the wool. Padding or exhaustion techniques can also be used. Equivalent systems are also available which includes the Dylan GRB process from Precision Products (Textiles) Ltd.

In another embodiment of the present disclosure, the above pre-treated/pre-chlorinated fabric is subjected to further treatment and converted into a desired garment by conventionally known industrial methods. The fabric converted into a garment is further subjected to the prepared chemical composition comprising the following constituents: water, cross linking agents, polymers, proteins and alkaline reducing agent. Once the prepared chemical liquor composition is loaded on to the garment using a spraying machine, the garment is dried in a drying machine. For the required crease setting and to obtain the desired wrinkle free feel, this treated garment is subjected to curing. The constituents are further neutralized and oxidized by specific acids and oxidizing agents respectively. The treated garment is further dried to obtain the completely wrinkle free garment.

The process involved in the present disclosure can be further illustrated by way of exemplification, with the help of the following chemical reactions:

$$HS_3O_3^- + W{-}S_1{-}S_2{-}W \rightarrow W{-}S_1H + W{-}S_2{-}S_3O_3^-$$

$$W{-}S_1H \rightarrow W{-}S_1^- + H^+$$

$$W{-}S_1^- + W{-}S_4{-}S_5{-}W \rightarrow W{-}S_1{-}S_4{-}W + W{-}S_5^-$$

$$W{-}S_5^- + CH_3COOH \rightarrow W{-}S_5H \text{ (excess)}$$

$$2W{-}SH + H_2O_2 \rightarrow \text{Removal of excess thiolate ions}$$

In another embodiment of the present disclosure, in the above defined chemical reaction, the Subscripts in sulfur (1-5) have been used to distinguish between different sulfur atoms and the wool (W) polypeptide chains to which they are attached and thereby interact with. As depicted in the reaction the Alkaline reducing agent, for example sodium bisulphate brings about the reduction and is commonly used as the chemical setting agent for the wool. The reduction process causes the synthesis of the thiolate ions in the liquor medium and further results in the rearrangement of disulphide bonds and thereby brings about the efficient setting of the wool. After permanent setting, the alkaline condition of the medium is neutralized using an acid such as acetic acid or formic acid to decrease the pH of the medium. The sodium bisulphate can be removed by efficient rinsing at low temperature and the excess thiolate ions generated in the process is removed by treating the wool with a suitable oxidizing agent such as hydrogen peroxide.

In another embodiment of the present disclosure, synthapret BAP used in the examples below, is a water soluble bi-sulfite adduct of tri-functional isocyanate terminated urethane polymer. It forms interfibre bonds that are sufficiently strong to withstand the domestic laundering; hence the adhesive forces are the most relevant in determining the shrink resist efficiency.

In another embodiment of the present disclosure, the Polymer used in the present disclosure is a polyurethane, chosen from polyurethane Baypret USV, Ultrafab HPU or Hydroperm RPU. These mainly determine the soft handfeel and the bounciness of the fabric. The protein used was L-cystine, which is mainly used to get better shape retention after wash. Since pH is an important factor in any reaction sodium bicarbonate is used.

In the present disclosure, oxidising agents, such as hydrogen peroxide, are suitable for this purpose. The pH of wool can be adjusted with any suitable acid, such as acetic or formic acid. If oxidizing agents are not used, oxidation can take place very slowly in air, but the results may not be satisfactory if the fabric is not held in its desired permanent shape while oxidation is taking place.

The present disclosure enables woven products made of 100% machine washable wool to withstand 10 machine wash cycles (Home Laundry) as per AATCC-143-2006 standards with delicate wash cycle at 30° C. washing temperature. As per these standards, the Durable press and crease retention rating would be grade 4 up to 10 washes.

The examples elaborated below, make use of the applicable terminologies, such as Smoothness appearance (SA), Seam smoothness and the Crease retention (CR), used by persons skilled in the art to define wrinkle free nature of a Garment.

The composition of instant disclosure is synergistic in nature. The composition shows extraordinary activity in obtaining wrinkle free garment. The activity of the composition is well beyond the expectations of the inventors and is also significantly more than the additive effects of the individual components namely cross linking agent, polymer, L-cystine and alkaline reducing agent, of the composition. Thus, the activity is surprising/extra-ordinary, synergistic in nature when combined together and is thus both novel and inventive in nature. Lastly, the Industrial Application of the composition is also well-established. Therefore, the instant composition is a leap forward in the textile industry.

The present disclosure is further described with the help of the following examples and figures. However, these examples should not be construed to limit the scope of the disclosure.

EXAMPLE 1

A pre-chlorinated/treated woolen fabric is taken and converted into a desired garment by industrially known methods. This garment is further subjected to the wrinkle free treatment to obtain the desired wrinkle free effect.

1. Chemical Composition

This garment is taken and is treated with the prepared chemical composition comprising of the following constituents: (all % based on the weight of the liquor)

| | |
|---|---|
| Normal water (about 25° C. to about 30° C.) | appx: 13 ltr |
| Cross linking Agent | about 4 to about 6% |
| Polymer | about 4 to about 6%. |
| Protein (L-Cystine extracted from Human Hair) | about 0.5 to about 1.5% |
| Alkaline Reducing agent: | about 2 to about 4% |
| And Sodium bi-carbonate: to maintain pH | about 8.5 to about 10.5 |

The above mentioned chemical constituents, in the mentioned concentrations when dissolved in water constitute the liquor solution.

The cross linking agent comprise of bisulfite adduct of tri-functional isocyanate terminated urethane polymer and epoxy-functional polyacrylate preferably polyethylenimine.

The polymer comprises of polyurethane, polyether polyurethane polymer and polyethylene adipate based hydrophilic polyurethane.

The alkaline reducing agent comprise of sodium bisulfite, sodium meta bisulfite and sodium mono ethylamine sulfite.

2. Chemical Treatment and Drying:

Once the chemical composition is prepared, loading of the garments (inside out) is done in the spraying machine. Then the prepared liquor is sprayed in a closed chamber of rotating spraying machine through pump and sprayer. After about 10 minutes, the sprayed garments will be subjected to drying in a drying machine.

3. Steam Pressing of Garment:

The next step involves steam pressing of the garment. A steam press, sometimes called a Hoffman press, of the type commonly used for pressing creases (for example imparting center crease in a trouser).

A typical press consists of an upper head and a lower buck which can be brought together to hold fabric under lateral compression while it is steamed. The head is a thinly padded, while the buck is covered with thick padding and is somewhat more resilient than the head. Steam can be introduced through either the head or buck and the buck can be connected to a vacuum pump.

The pressing operation consists of three basic steps:

a. The garment is compressed between the head and the buck and steam is passed through the fabric, usually from head to buck (steaming cycle).
b. The steam is turned off while the press remains closed (baking cycle).
c. A vacuum is applied to the buck as the press is opened and the fabric is cooled by drawing ambient air through it (vacuum cycle). Cycles may vary from a few seconds up to one minute's duration. A typical procedure is about 8-about 10 seconds steam, about 6-about 10 seconds bake and about 4-about 10 seconds vacuum. The process has a number of variables that are thought to contribute to its effectiveness:
   the temperature and relative humidity of the steam,
   the temperature of the buck,
   the thickness of the buck padding,
   the vacuum pressure,
   the steaming, baking and vacuuming times,
   the mechanical pressure between the head and the buck,
   the regain of the fabric.

4. Curing:

After steam pressing, the garments (as trousers) are subjected to curing for crease setting. Further, the garments are exposed to high temp in a closed chamber to get the wrinkle free effect in the woolen fabric of the garment. In the curing process the temperature is an important factor, wherein the best temperature range was found to be about 155 to about 165 degree Celsius. Once curing is completed, the garments are subjected to cooling.

5. Oxidation and Neutralization:

As the chemical treatment of the woolen garments was done in an alkaline medium, it has to be neutralized by using Acetic acid (1% weight of liquor). During this process excess thiolate ion are generated due to re-arrangement of disulfide bond. Hence to remove the excess thiolate ions, an oxidizing agent such as Hydrogen peroxide (2% on the weight of liquor) is added to the liquor solution. If oxidation agent is not used, oxidation can take place very slowly in air but the results may not be satisfactory, if the garment is not held in its desired permanent shape while oxidation is taking place. Subsequently upon neutralization and oxidation, the garment is subjected to drying along with simple touch-up ironing to remove unwanted creases.

EXAMPLE 2

The following protocol is applicable in case of fabric which is not pre-treated or pre-chlorinated. Therefore initially the raw fabric is subjected to chlorination using one of the conventional methods available for pre-treatment which is outlined below:

Chlorination by Batch Treatment with DCCA

Fabric is run for about 10 minutes with cold 1-2% Leophen M (BASF) and 3% acetic acid (60%) at pH 3.5-4.5. The fabric is thereafter treated for about 30 to about 45 minutes in the same cold bath with 3.0% Basolan DC at pH 4 to 4.5. The unreacted chlorine is then removed from the fabric by treating it for 10 minutes in the same cold bath with 2.0% sodium metabisulfite. Then the bath is removed and the fabric rinsed and subjected to further treatment.

The fabric is then converted into a garment by conventionally known industrial methods and is subjected to the same treatment as described in Example 1, wherein the garment is first treated with the prepared chemical composition by spraying it inside out in a spraying machine. After 10 minutes, the garment is dried in a drying machine.

The garment then undergoes steam pressing using the Hoffman press for imparting crease into the garment. The next step involves curing of the garment for crease setting followed by the neutralization and oxidation of the garment in order to achieve the complete wrinkle free effect of the woolen garment. Once the whole protocol is completed the fabric is subjected to the final step of drying to obtain the ready use wrinkle free garment.

EXAMPLE 3

The raw-fabric to be converted into a wrinkle free garment can be subjected to chlorination using an alternative method. This is done in the following way with the continuous treatment with DCCA:

Chlorination by Continuous Treatment with DCCA

Basolan DC may be applied continuously, by padding with a liquor containing 10-30 g/l Basolan DC (0.6-3.0% o.w.w.) and 5 g/l Laventin CW (BASF) (a nonionic wetting agent which is stable to chlorine) at 60-80% pick-up. The fabric then passes to anti-chlorination and rinsing stages as described below. Efficient ventilation is required to exhaust chlorine gas emitted during the process.

Once the raw fabric is chlorinated, it is subjected to anti-chlorination and rinsing as described below:

After-Treatment of Fabric Continuously Treated with Chlorine

After continuous treatment with chlorine, about a three minutes dwell time is required for the chlorine to react, then the un-reacted chlorine is removed in one of the three following ways:

(i) By exhaustion in a cold bath with 2.0% sodium metabisulfite for 10 minutes, at a liquor ratio of 30:1.

(ii) By padding wet on wet with 20 g/l sodium metabisulfite solution. The resulting sulfur dioxide fumes should be removed by ventilation and scrubbing system.

(iii) By continuous washes in a washing range as described below:

bowl 1 cold rinse
bowl 2 10 g/l Blankit D (BASF) at 90° C.
bowl 3 empty to allow reaction to take place
bowl 4 cold rinse
bowl 5 cold rinse.

The treated and further anti-chlorinated fabric is then converted into a garment by conventionally known methods and is subjected to the treatment as described in Example 1, wherein the garment is first treated with the prepared chemical composition by spraying it inside out in a spraying machine. After 10 minutes, the garment is dried in a drying machine.

The garment then undergoes steam pressing using the Hoffman press for imparting crease into the garment. The next step involves curing of the garment for crease setting followed by the neutralization and oxidation of the garment in order to achieve the complete wrinkle free effect of the woolen garment. Once the whole protocol is completed the garment is subjected to the final step of drying to obtain the ready use wrinkle free garment.

EXAMPLE 4

The raw fabric can be pre-treated with yet another conventional method of Chlorination as described below. The fabric is then subjected to protocols as described in the previous example, to convert the given raw fabric into a wrinkle free garment.

Chlorination by Continuous Treatment with Chlorine in Water

Fabric can be chlorinated continuously in open width by passing it through a Kroy chlorinating unit. An aqueous acidic solution of chlorine is sprayed onto the fabric at the start of its passage into a very deep, narrow trough and reaction occurs very rapidly as the fabric passes through the machine. After squeezing, the fabric is passed to an open-width washer where it receives further treatment of anti-chlorination.

This fabric is further converted into a desired garment by conventionally known methods. This garment is further subjected to spraying of the chemical composition, steam pressing, curing, neutralization and the oxidation procedures as described in example 3 recited above. Once the treatment is completed the garment is subjected to drying, to obtain the desired wrinkle free garment.

EXAMPLE 5

Laboratory tests were conducted on various woolen fabrics, wherein the pre-treated or the pre-chlorinated fabric was converted into a desired garment and subjected to the prepared liquor solution comprising the following constituents in their specific concentrations. The liquor composition comprises of a cross linking agent, a polyurethane, a protein and an alkaline reducing agent dissolved in distilled water.

The cross linking agent used in this example was Synthapret Bi-ammonium Phosphate, whereas the polyurethane added was Baypret USV. The protein source included in the present disclosure is L-Cystine and the Alkaline reducing agent was sodium bisulfite along with sodium bi-carbonate to maintain the pH. The relative concentrations of the constituents used are represented in Table 1 below. The woolen garment was sprayed inside out, with the liquor solution comprising the above mentioned constituents in their respective concentrations for 10 minutes and then dried in a drying machine. The chemical treatment and drying of the garment was followed by the process of steam pressing using a Hoffman press (for example imparting center crease in a trouser), curing for crease setting, neutralization of the alkaline medium using the acidic solutions and then followed by oxidizing the generated excess thiolate ions using hydrogen peroxide (as mentioned in the Example 1). The garment is finally sent for drying and then tested for the specified parameters required to confirm the wrinkle free nature of the garment. The various parameters taken into account for testing the garment's wrinkle free nature were: Smoothness appearance (SA), Seam smoothness and the Crease retention (CR).

Furthermore, apart from the specific constituents used above the cross linking agent comprise of bisulfite adduct of tri-functional isocyanate terminated urethane polymer and epoxy-functional polyacrylate preferably polyethylenimine. The polymer further comprises of polyurethane, polyether polyurethane polymer and polyethylene adipate based hydrophilic polyurethane. The alkaline reducing agent is selected from sodium bisulfite, sodium meta bisulfite and sodium mono ethylamine sulfite.

Smoothness appearance: The visual impression of planarity of a specimen quantified by comparison with a set of reference standards, after standard home laundering. Evaluation is performed using a standard lighting and viewing area by rating the appearance of specimen in comparison with appropriate reference standards.

Crease retention: The visual impression of an inserted crease quantified by comparison with a set of reference standards.

Seam smoothness: The visual impression of planarity of seamed specimen quantified by comparison with set of reference standards.

The Visual standards are available at a rating of 1 to 5, wherein 1 is the lowest and 5 is the highest rating.

TABLE 1

| CHEMICAL CONSTITUENTS | TRADE NAME USED | CONCENTRATION |
|---|---|---|
| Cross Linking Agent | Synthapret Bi-ammonium Phosphate | 5% |
| Polymer | Baypret USV | 5% |
| Protein Source | L-Cystine | 0.5% |
| Alkaline Reducing Agent (Sodium Bisulphite) | | 3% |
| Base to maintain alkaline pH (Sodium Bi-carbonate) | | pH 8.5-10.5 |
| Normal Water (about 25° C. to about 30° C.) | | Approx. 13 Litres |

The testing of the woolen garment for the effectiveness of the present treatment was done in such a way that the efficiency of the treatment was checked after one, five and ten washes. The machine wash was conducted for 8 minutes, 80° F. in 45 ml of the Prepared Liquor solution (with the concentration of the constituents as mentioned above), followed by low Tumble drying of the garment.

The test results obtained were based on the parameters chosen as indications for determining the wrinkle free nature of the garment. These ratings of the parameters were tested over a scale of 1 to 5, wherein the rating of 4 provided for the high performing parameter and the lowest performing parameter attained a rating of 1. If a garment showed the value as 4 for all the parameters tested, then along with the soft handfeel and bounciness of the garment put together, it could be determined whether the treatment has been completely effective or not, and hence concluded if the garment has become permanently wrinkle free in nature.

With respect to the present example, the garment showed a Smoothness appearance rating of 4.0, Seam smoothness of 3.5 and the Crease retention rating of 4.0, after the first and the fifth wash respectively. After the tenth wash, the garment did not depict any change in any of these ratings and the garment also had the desired handfeel and bounciness expected to establish it as wrinkle free in nature and maintaining the same parameters ratings even after 10 washes.

EXAMPLE 6

In another set of similar experiments, tests were conducted with the pre-treated or the pre-chlorinated fabric converted into a garment, wherein the concentrations were varied to determine the most optimum and the most suitable working concentration ranges of the constituents. The liquor solution's constituents were the same as mentioned in the previous example with a difference in the concentrations used, as elaborated in table 2 below.

Furthermore, apart from the specific constituents used above the cross linking agent comprise of bisulfite adduct of tri-functional isocyanate terminated urethane polymer and epoxy-functional polyacrylate preferably polyethylenimine. The polymer further comprises of polyurethane, polyether polyurethane polymer and polyethylene adipate based hydrophilic polyurethane. The alkaline reducing agent is selected from sodium bisulfite, sodium meta bisulfite and sodium mono ethylamine sulfite.

TABLE 2

| CHEMICAL CONSTITUENTS | TRADE NAME USED | CONCENTRATION |
|---|---|---|
| Cross Linking Agent | Synthapret Bi-ammonium Phosphate | 2.5% to <3% |
| Polymer | Baypret USV | 5% |
| Protein Source | L-Cystine | 0.5% |
| Alkaline Reducing Agent (Sodium Bisulphite) | | 3% |
| Base to maintain alkaline pH (Sodium Bi-carbonate) | | pH 8.5-10.5 |
| Normal Water (about 25° C. to about 30° C.) | | Approx. 13 Litres |

The prepared liquor solution comprising the said constituents was sprayed on the pre-treated or the pre-chlorinated garment. The sprayed garment was subjected to further treatment of drying, steam pressing, curing for crease setting, neutralization and oxidation. The dried garment is then tested for the same parameters as those mentioned in the previous example for confirming the wrinkle free nature of the garment. The tests varied with change of the concentration value with respect to the cross linking agent being used. Specifically, when the concentration value was lowered, the parameters were seen to have a proportional decrease. The reason for this was attributed to be insufficient interfibre bonding, which was found necessary to bring about the desired level of wrinkle free effect.

In a similar fashion as in the previous example the garment was tested after one wash followed by a testing done after five washes. The results were found to be dissatisfactory in terms of the wrinkle free nature expected. The treated garment showed Durable press rating of less than 3.0 and the Crease retention rating of also less than 3.0, after the first and the fifth wash respectively. Hence it can be firmly concluded that the said concentration values used in this particular example are not efficient in bringing about the complete wrinkle free effect and hence concentrations in the mentioned range of 3-6% are seen to bring about the most preferred results in terms of wrinkle free effect of the garment.

EXAMPLE 7

Another experiment was conducted on similar lines, by changing the concentration values of the constituents. The concentration of cross linking agent was modified as represented in table 3 below, while the concentration of rest of the constituents remained the same.

Furthermore, apart from the specific constituents used above the cross linking agent comprise of bi-sulfite adduct of tri-functional isocyanate terminated urethane polymer and epoxy-functional polyacrylate preferably polyethylenimine. The polymer further comprises of polyurethane, polyether polyurethane polymer and polyethylene adipate based hydrophilic polyurethane. The alkaline reducing agent is selected from sodium bisulfite, sodium meta bisulfite and sodium mono ethylamine sulfite.

TABLE 3

| CHEMICAL CONSTITUENTS | TRADE NAME USED | CONCENTRATION |
|---|---|---|
| Cross Linking Agent | Synthapret Bi-ammonium Phosphate | 6% |
| Polymer | Baypret USV | 5% |
| Protein Source | L-Cystine | 0.5% |
| Alkaline Reducing Agent (Sodium Bisulphite) | | 3% |
| Base to maintain alkaline pH (Sodium Bi-carbonate) | | pH 8.5-10.5 |
| Normal Water (about 25° C. to about 30° C.) | | Approx. 13 Litres |

The garment was again sprayed inside out with the liquor solution, followed by drying and subjected to further treatments. The dried garment was initially neutralized and then oxidized to obtain the fully treated garment, which is further dried and then tested.

The testing was done on similar parameter lines as those mentioned in the previous examples and hence the garment was washed in a solution containing said the chemical composition. To check the efficiency of the composition, the garment was tested for the same parameters after more than one wash, specifically after five washes and the results obtained were recorded.

The results obtained confirmed that the working concentration range was 3-6%, and the cross linking agent was effective at the said concentration level of 6%. The garment was seen to depict a Durable press rating of 4.0 and Crease retention rating of 4.0, after the first and the fifth wash. Hence the range of 3 to 6% as mentioned above is the most preferred range of this cross linking agent that would bring about effective wrinkle free nature of the garment.

EXAMPLE 8

In another set of experiments, the concentration of the polymer is modified to determine the efficiency of the chemical composition of the present disclosure.

Furthermore, apart from the specific constituents used above the cross linking agent comprise of bisulfite adduct of tri-functional isocyanate terminated urethane polymer and epoxy-functional polyacrylate preferably polyethylenimine. The polymer further comprises of polyurethane, polyether polyurethane polymer and polyethylene adipate based hydrophilic polyurethane. The alkaline reducing agent is selected from sodium bisulfite, sodium meta bisulfite and sodium mono ethylamine sulfite.

The constituents and their respective concentrations are defined in table 4 below:

TABLE 4

| CHEMICAL CONSTITUENTS | TRADE NAME USED | CONCENTRATION |
|---|---|---|
| Cross Linking Agent | Synthapret Bi-ammonium Phosphate | 5% |
| Polymer | Baypret USV | 6% |
| Protein Source | L-Cystine | 1.5% |
| Alkaline Reducing Agent (Sodium Bisulphite) | | 3% |
| Base to maintain alkaline pH (Sodium Bi-carbonate) | | pH 8.5-10.5 |
| Normal Water (about 25° C. to about 30° C.) | | Approx. 13 Litres |

The composition used in the present example is such that the cross linking agent used is Synthapret BAP, along with the Polyurethene-Baypret USV but at a varied concentration value of 6%, together with the protein L-Cystine and the Alkaline reducing agent was Sodium Bisulphite along with Sodium bi-carbonate to maintain the pH. The garment is sprayed with the chemical composition for 10 minutes and then dried and subjected to further treatments. The dried garment is then taken for steam pressing followed by curing to set the crease, followed by neutralization and then oxidation to obtain the garment which is ready to be dried and thereafter tested. The garment so treated in tested on the various parameters like Smoothness appearance, Seam smoothness and the Crease retention. The results obtained were recorded such that the garment was tested after a single wash, five washes and ten washes. On a scale of 4 for each of the parameters (as defined in example 7), such that 4 determines the highest value and 1 determines the lowest, the garment so treated showed positive results. The Durable press Rating and the Crease Retention was found to have a value of 4, and moreover the handfeel and the bounciness of the garment were seen to be excellent even after completion of ten washes. Hence it can be established that the garment was able to retain the wrinkle free nature permanently and is not restricted only to a single wash.

EXAMPLE 9

Similar trials were conducted to determine the effect of change in concentration value of polyurethane on the wrinkle free nature of the garment. This was done in such a way that the pre-treated garment was sprayed with the chemical composition such that the cross linking agent used was Synthapret BAP, along with the polyurethane chosen as Baypret USV. However, the concentration value of Baypret USV was much lower than that been tested in above examples and mentioned in the effective range for this disclosure. The respective concentrations of the cross linking agent, polyurethane, along with L-Cystine, Alkaline reducing agent and sodium bi-carbonate are represented in table 5 below.

Furthermore, apart from the specific constituents used above the cross linking agent comprise of bisulfite adduct of tri-functional isocyanate terminated urethane polymer and epoxy-functional polyacrylate preferably polyethylenimine. The polymer further comprises of polyurethane, polyether polyurethane polymer and polyethylene adipate based hydrophilic polyurethane. The alkaline reducing agent is selected from sodium bisulfite, sodium meta bisulfite and sodium mono ethylamine sulfite.

TABLE 5

| CHEMICAL CONSTITUENTS | TRADE NAME USED | CONCENTRATION |
|---|---|---|
| Cross Linking Agent | Synthapret Bi-ammonium Phosphate | 5% |
| Polymer | Baypret USV | 2% |
| Protein Source | L-Cystine | 0.5% |
| Alkaline Reducing Agent (Sodium Bisulphite) | | 3% |
| Base to maintain alkaline pH (Sodium Bi-carbonate) | | pH 8.5-10.5 |
| Normal Water (about 25° C. to about 30° C.) | | Approx. 13 Litres |

The chemical treatment was followed by the drying procedure, steam pressing and curing for crease retention, neutralization, oxidation and drying. The garment was tested for just a single Machine wash and the results recorded. The Durable press Rating and the Crease Retention were seen to produce the desired rating of 4 for both the parameters, however the handfeel and the bounciness were not as expected and hence this concentration range was concluded not to bring about the desired wrinkle free effect.

EXAMPLE 10

Further tests were conducted by altering the polyurethane used in the chemical composition. The pre-treated garment was subsequently subjected to treatment with the prepared chemical composition. The chemical composition comprised of Synthapret BAP and the polyurethane chosen was Ultrafab HPU or Hydroperm RPU. These are both hydrophilic polyurethane and are used at the same concentration range of 3 to 6%, as that of Baypret USV. The constituents and their respective concentrations are provided in table 6.

Furthermore, apart from the specific constituents used above the cross linking agent comprise of bisulfite adduct of tri-functional isocyanate terminated urethane polymer and epoxy-functional polyacrylate preferably polyethylenimine. The polymer further comprises of polyurethane, polyether polyurethane polymer and polyethylene adipate based hydrophilic polyurethane. The alkaline reducing agent is selected from sodium bisulfite, sodium meta bisulfite and sodium mono ethylamine sulfite.

TABLE 6

| CHEMICAL CONSTITUENTS | TRADE NAME USED | CONCENTRATION |
|---|---|---|
| Cross Linking Agent | Synthapret Bi-ammonium Phosphate | 5% |
| Polymer | Baypret USV | 2% |
| Protein Source | L-Cystine | 0.5% |

TABLE 6-continued

| CHEMICAL CONSTITUENTS | TRADE NAME USED | CONCENTRATION |
|---|---|---|
| Alkaline Reducing Agent (Sodium Bisulphite) | | 3% |
| Base to maintain alkaline pH (Sodium Bi-carbonate) | | pH 8.5-10.5 |
| Normal Water (about 25° C. to about 30° C.) | | Approx. 13 Litres |

As mentioned in the previous example the chemical composition is hence sprayed on the garment and this is dried, and steam pressed and cured for crease setting. The further step of neutralization and oxidation is done to complete the procedure, and finally drying is done before checking the garment for the wrinkle free effect. The tests were conducted based on the same parameters used in the previous examples. The tests were done after a single wash, five washes and ten washes. However the results were found to be the same at every stage of the testing. The Durable press Rating and the Crease Retention were found to have a value of 4, the highest in the scale for the parameters. Hence these alternatives were found to depict a similar effect as the other polyurethane and the wrinkle free effect was found to be permanent and as desired.

EXAMPLE 11

In every chemical reaction, pH is an important factor, which determines the rate of a reaction. In the present disclosure, the chemical reaction occurs more rapidly when the pH is alkaline. Specifically when the pH approaches 9 the reaction achieves its maximum rate. Further in weak alkaline conditions the reaction never completes. Hence it is very important that the pH is maintained throughout the reaction, and for this use, sodium bisulfite and later sodium bi-carbonate are added to maintain the pH. The pre-treated garment is first subjected to the treatment with the prepared chemical composition for 10 minutes. The chemical composition had Synthapret BAP as the cross linking agent. The polyurethane chosen was Baypret USV, the protein source was L-Cystine and the Alkaline reducing agent used was sodium bisulfite along with sodium bi-carbonate.

Furthermore, apart from the specific constituents used above the cross linking agent comprise of bisulfite adduct of tri-functional isocyanate terminated urethane polymer and epoxy-functional polyacrylate preferably polyethylenimine. The polymer further comprises of polyurethane, polyether polyurethane polymer and polyethylene adipate based hydrophilic polyurethane. The alkaline reducing agent is selected from sodium bisulfite, sodium meta bisulfite and sodium mono ethylamine sulfite.

TABLE 7

| CHEMICAL CONSTITUENTS | TRADE NAME USED | CONCENTRATION |
|---|---|---|
| Cross Linking Agent | Synthapret Bi-ammonium Phosphate | 5% |
| Polymer | Baypret USV | 5% |
| Protein Source | L-Cystine | 1% |
| Alkaline Reducing Agent (Sodium Bisulphite) | | 0.5%-1% |
| Base to maintain alkaline pH (Sodium Bi-carbonate) | | pH 8.5-10.5 |
| Normal Water (about 25° C. to about 30° C.) | | Approx. 13 Litres |

However, in the present experiment, the concentration of alkaline reducing agent Sodium Bisulphite was taken at a lower concentration of 0.5 to 1%. This constituent is responsible for the bonding with wool; however at a lesser concentration effective bonding does not occur.

As previously mentioned in the example above, this chemical composition is sprayed on the garment followed by drying; steam pressing and then curing is done for crease setting. The further step of neutralization and oxidation is done to complete the procedure. Finally, drying is carried out before testing the garment for the wrinkle free effect. The tests were conducted based on the same parameters used in the previous examples, and were done after a single wash as well as with five washes. The results hence obtained were recorded and were found to be slightly different when compared with those of the previous examples. The Durable press Rating was found to be 4, the highest rating in the scale taken, but the Crease Retention was found to have a value of 3, lower than the standards already obtained when the concentration of Sodium Bisulphite was taken higher. Hence it was concluded that the above tested concentration of Sodium Bisulphite was not the one which gave the best results and hence the optimum working concentration of this ingredient was decided to be 2-4%.

All the examples of the present disclosure were carried out using the standard protocols as set out by AATCC-143-2006 standards. The present disclosure enables woven products made of 100% machine washable wool to withstand 10 machine wash cycles (delicate cycle of Home Laundry at 30° C. wash temperature). As per these standards, the Durable press and crease retention rating were graded 4 as being the best rating.

Hence it can be concluded that the said chemical preparation is most effective in the said concentration ranges and with the specified constituents. The chemical constituents bring about the wrinkle free effect of the woolen garment and comprise of the following: a cross linking agent: Synthapret BAP at a concentration range of 4-6%, a Polymer, Polyurethane-Baypret USV, Ultrafab HPU or Hydroperm RPU at a concentration range of 3-6%, L-Cystine at concentration range of 0.5% to 1.5%, sodium bisulfite at a range of 2-4% and sodium bi-carbonate to maintain the pH at 8.5 to 10.5.

Advantages of Wrinkle Free Garments:

- Dry cleaning will no longer be compulsory for 100% wool.
- No need for Ironing. Just wash, dry & wear.
- This will also be a move towards ECO friendly process as we can avoid petrochemical base products used while dry cleaning.
- Shape retention will be excellent.
- Smoothness Appearance will be excellent after repeated home laundering.
- Together with the functionality and flexibility required for today's busy lifestyle, this technology will help us save time and money.

I claim:

1. A composition consisting of cross linking agent selected from the group consisting of epoxy-functional polyacrylate and polyethylenimine, polymer, L-cystine, alkaline reducing agent, and water.

2. The composition as claimed in claim 1, wherein the composition is maintained at a pH ranging from about 8.5 to about 10.5.

3. The composition as claimed in claim 1, wherein each of the cross linking agent and polymer are present at a concentration ranging from about 4% to about 6%, the L-cystine is present at a concentration ranging from about 0.5% to about 1.5% and the alkaline reducing agent is present at concentration ranging from about 2% to about 4% of total volume of the composition.

4. The composition as claimed in claim 1, wherein the polymer is selected from the group consisting of polyurethane, polyether polyurethane polymer and polyethylene adipate based hydrophilic polyurethane, and wherein the alkaline reducing agent is selected from the group consisting sodium bisulfite, sodium meta bisulfite and sodium mono ethylamine sulfite.

5. The composition as claimed in claim 1, wherein the composition is formulated into solid forms selected from the group consisting of powder and granule, and liquid forms selected from the group consisting of emulsion, suspension and aerosol using water.

6. A composition as claimed in claim 1, wherein the composition is loaded on a garment.

7. A method to obtain a composition consisting of cross linking agent selected from the group consisting of epoxy-functional polyacrylate and polyethylenimine, polymer, L-cystine, alkaline reducing agent, and water, said method comprising the step of combining cross linking agent selected from the group consisting of epoxy-functional polyacrylate and polyethylenimine, polymer, L-cystine, and alkaline reducing agent in water to obtain the composition.

8. The method as claimed in claim 7, wherein the composition is maintained at a pH ranging from about 8.5 to about 10.5, and wherein the pH maintenance of composition generates foam which settles in a time period of about 5 minutes to 10 minutes followed by filtration to obtain the composition.

9. The method as claimed in claim 7, wherein the composition is obtained by combining each of the cross linking agent and the polymer in individual concentration ranging from about 4% to about 6%, L-cystine in a concentration ranging from about 0.5% to about 1.5% and alkaline reducing agent in a concentration ranging from about 2% to about 4% of total volume of the composition.

10. A method for obtaining a wrinkle free garment, said method comprising step of loading a garment with a composition consisting of cross linking agent selected from the group consisting of epoxy-functional polyacrylate and polyethylenimine, polymer, L-cystine, alkaline reducing agent, and water to obtain the wrinkle free garment.

11. The method as claimed in claim 10, wherein the composition is maintained at a pH ranging from about 8.5 to about 10.5.

12. A method for obtaining wrinkle free garment, said method comprising steps of:

a. loading a garment obtained from pre-treated fabric with a composition consisting of cross linking agent selected from the group consisting of epoxy-functional polyacrylate and polyethylenimine, polymer, L-cystine, alkaline reducing agent, and water, and b. treating the loaded garment to obtain the wrinkle free garment.

13. The method as claimed in claim 12, wherein the composition is maintained at a pH ranging from about 8.5 to about 10.5, and wherein the pre-treatment of the fabric is carried out by chlorination.

14. The method as claimed in claim 12, wherein the treatment comprises steps of drying, pressing, curing, neutralization and oxidation of the loaded garment, and wherein the curing is carried out at temperature ranging from about 155° C. to about 165° C.

* * * * *